US009377208B2

(12) United States Patent
Seo

(10) Patent No.: US 9,377,208 B2
(45) Date of Patent: Jun. 28, 2016

(54) FLOATING TYPE HUMIDIFIER

(71) Applicant: Dong Jin Seo, Seoul (KR)

(72) Inventor: Dong Jin Seo, Seoul (KR)

( * ) Notice: Subject to any disclaimer, the term of this patent is extended or adjusted under 35 U.S.C. 154(b) by 159 days.

(21) Appl. No.: 14/376,550

(22) PCT Filed: Jul. 14, 2014

(86) PCT No.: PCT/KR2014/006323

§ 371 (c)(1),
(2) Date: Aug. 4, 2014

(87) PCT Pub. No.: WO2015/008997

PCT Pub. Date: Jan. 22, 2015

(65) Prior Publication Data

US 2015/0323204 A1 Nov. 12, 2015

(30) Foreign Application Priority Data

Jul. 15, 2013 (KR) ..... 10-2013-0083045

(51) Int. Cl.

| | |
|---|---|
| ***F24F 6/12*** | (2006.01) |
| ***B01F 3/04*** | (2006.01) |
| ***B05B 17/06*** | (2006.01) |

(52) U.S. Cl.

CPC ..... *F24F 6/12* (2013.01); *B01F 3/0407* (2013.01); *B05B 17/0623* (2013.01); *F24F 2221/26* (2013.01)

(58) Field of Classification Search

CPC ..... F24F 6/12; B01F 3/04; B01F 3/04007; B01F 3/0407; B01F 3/04021

USPC ..... 261/78.2, 81, 119.1, 120; 392/403, 404

See application file for complete search history.

(56) References Cited

U.S. PATENT DOCUMENTS 6,592,107 B1 * 7/2003 Wong ..... F24F 6/02 261/107

FOREIGN PATENT DOCUMENTS

| | | | |
|---|---|---|---|
| JP | 07213968 A | * | 8/1995 |
| JP | 2010107097 A | * | 5/2010 |
| KR | 20-0430954 Y1 | | 11/2006 |
| KR | 10-2009-0092674 A | | 9/2009 |
| KR | 10-2011-0066067 A | | 6/2011 |
| KR | 10-1207904 B1 | | 12/2012 |

* cited by examiner

*Primary Examiner* — Robert A Hopkins
(74) *Attorney, Agent, or Firm* — Novick, Kim & Lee, PLLC; Sang Ho Lee

(57) ABSTRACT

Provided is a floating type humidifier, and more particularly, a floating type humidifier capable of humidifying an indoor area by using an external water source while floating on water due to use of a floating unit of a hollow type so that the floating type humidifier discharges water droplets or vapour in a floating state. The floating type humidifier includes a floating body having a hollow and a water inlet hole in a lower portion through which water is introduced from the outside so that the floating body floats in a water container; an ultrasound vibrator inserted in the water inlet hole of the floating body to change the water introduced from the water container into water particles or vapor; a guide coupled to an upper end portion of the water inlet hole of the floating body to guide the water particles or the vapor generated by the ultrasound vibrator to the outside, and formed like a pipe having a guide hole in a side surface; and a discharge unit provided on the floating body under the guide hole so as to guide the water particles or the vapor from the guide to the guide hole and to discharge the water particles or the vapor to the outside.

13 Claims, 4 Drawing Sheets

FLOATING TYPE HUMIDIFIER

TECHNICAL FIELD

The present invention relates to a floating type humidifier, and more particularly, to a floating type humidifier capable of humidifying an indoor area by using an external water source while floating on water due to use of a hollow type floating unit so that the floating type humidifier discharges water droplets or vapour in a floating state.

BACKGROUND ART

In general, a humidifier is a device that humidifies a dry indoor space. According to a humidifying process, humidifiers may be classified in ultrasound humidifiers using ultrasound waves and heating humidifiers using a heater.

In the ultrasound humidifier, water stored in a water container that may be detachable from a main body of the humidifier is supplied to a water container, and then, the water in the water container is converted into fine droplets by vibration of an ultrasound vibrator included in the water container. The fine droplets are sprayed through a spray nozzle in an atomized state with air by operation of a ventilation fan.

In the heating humidifier, water supplied in a water container is vaporized by a heater, and then, is sprayed through a spray nozzle with air in an atomized state by a ventilation fan as described above. The ultrasound humidifier and the heating humidifier have similar base structures, except for the difference between ways of generating fine droplets or vapour from the water in the water container by using the ultrasound oscillator or the heater.

The two types of above humidifiers have problems such as bacterial multiplication and cleaning difficulties, and to address these problems, natural type humidifiers that are easy to maintain, for example, are easy to clean, have been widely used.

From among the natural type humidifiers, a floating type humidifier has been widely used because maintenance such as cleaning of the humidifier is easy. The floating type humidifier changes water in a water container into fine water particles by using an ultrasound vibrator and sprays the fine particles to the outside while floating on water in the water container. In the floating type humidifier, electric power for driving the ultrasound vibrator may be supplied from batteries or from an external power source connected to the floating type humidifier via an electric wire.

If the electric power is supplied from the batteries, the batteries have to be replaced frequently if the humidifier is used for a long time. Thus, the floating type humidifier generally supplies the electric power to the ultrasound vibrator via the electric wire.

DISCLOSURE OF INVENTION

Technical Problem

The present invention provides a floating type humidifier which discharges water droplets or vapour in a floating state on water and is thus capable of humidifying an indoor area by using an external water source while floating on water due to use of a floating unit of a hollow type.

The present invention provides a floating type humidifier capable of performing efficient humidification by adjusting a spraying amount of water droplets or vapour generated by an ultrasound vibrator by controlling an electric power supplied to the ultrasound vibrator and a rotating speed of a fan.

Solution to Problem

According to an aspect of the present invention, there is provided a floating type humidifier comprising a floating body having a hollow and a water inlet hole in a lower portion through which water is introduced from the outside so that the floating body floats in a water container; an ultrasound vibrator inserted in the water inlet hole of the floating body to change the water introduced from the water container into water particles or vapor; a guide coupled to an upper end portion of the water inlet hole of the floating body to guide the water particles or the vapor generated by the ultrasound vibrator to the outside, and formed like a pipe having a guide hole in a side surface; and a discharge unit provided on the floating body under the guide hole so as to guide the water particles or the vapor from the guide to the guide hole and to discharge the water particles or the vapor to the outside.

Advantageous Effects of Invention

According to a floating type humidifier of the present invention, a floating body has a sealed hollow, and thus, the floating type humidifier may easily float on water.

In addition, a spray amount of water particles or vapour generated by using an ultrasound vibrator may be adjusted by controlling electric power supplied to the ultrasound vibrator and a rotating speed of a fan, and thus, humidification may be performed effectively.

Also, all components may be configured to be easily disassembled and assembled, slime or moss formed on a surface when the humidifier is used for a long time may be easily cleaned by disassembling the humidifier, and thus, the floating type humidifier may be maintained easily.

In addition, a light emitting diode (LED) is provided on the ultrasound vibrator or a case, and thus, an aesthetic effect may be obtained and the humidifier may be used as a lamp.

BEST MODE FOR CARRYING OUT THE INVENTION

Figure 1:
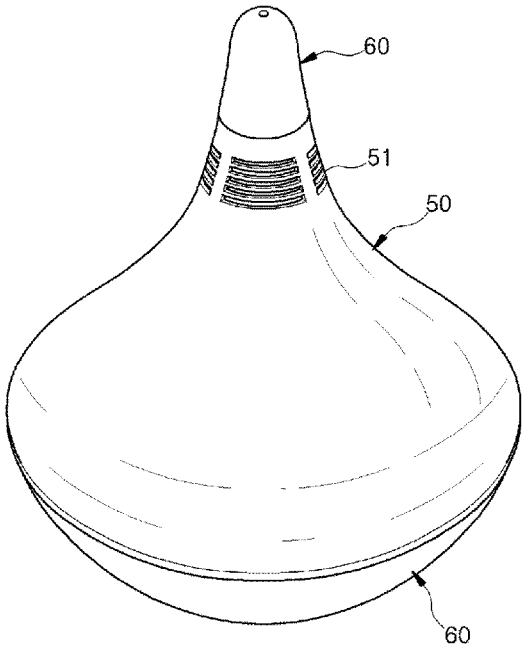
FIG. 1 is a perspective view of a floating type humidifier according to an embodiment of the present invention.

According to an aspect of the present invention, there is provided a floating type humidifier comprising a floating body having a hollow and a water inlet hole in a lower portion through which water is introduced from the outside so that the floating body floats in a water container; an ultrasound vibrator inserted in the water inlet hole of the floating body to change the water introduced from the water container into water particles or vapor; a guide coupled to an upper end portion of the water inlet hole of the floating body to guide the water particles or the vapor generated by the ultrasound vibrator to the outside, and formed like a pipe having a guide hole in a side surface; and a discharge unit provided on the floating body under the guide hole so as to guide the water particles or the vapor from the guide to the guide hole and to discharge the water particles or the vapor to the outside.

Preferably, the floating body may further comprise a case coupled to an upper portion of the floating body so as to accommodate the guide and comprising a plurality of air inlet holes in an outer portion for inducing external air.

Preferably, the case may further comprise a cap coupled to an upper end portion of the case and comprising an evaporation hole for controlling an evaporation amount and an evaporation direction of the water particles or the vapor discharged through the guide.

Preferably, the one or more evaporation holes may be formed in a tip portion or a side surface of the cap.

Preferably, the case may comprise a light emitting diode (LED) on an outer surface to illuminate the water particles or the vapor evaporated through the guide.

Preferably, the discharge unit may comprise one of a ventilation fan and an air pump.

Preferably, the electric power may be supplied to the ultrasound vibrator via a power line or a rechargeable battery.

Preferably, the electric power may be wirelessly supplied to the ultrasound vibrator.

Preferably, the ultrasound vibrator may be driven by electric power supplied wirelessly from a wireless charging pad provided under a bottom of the water container or from outside of the water container.

Preferably, the ultrasound vibrator may comprise an LED on an upper surface to emit light through an upper portion of the guide.

Preferably, the guide may further comprise a shielding portion protruding from an upper portion of the guide hole to the outside so as to collect the air supplied through the discharge unit toward the guide hole.

Preferably, the floating body may further comprise an inclined portion formed on an upper surface of the floating body, so that the water particles or the vapor that is generated by the ultrasound vibrator and is not discharged to the outside but is formed as droplets on the guide and the case flows along an outer surface of the guide and an inner surface of the case toward the water inlet hole, or the water introduced through a coupling portion between the floating body and the case is drained to the water inlet hole.

Preferably, the ultrasound vibrator and the discharge unit may further comprise a control unit for controlling electric power supplied to the ultrasound vibrator and the discharge unit so as to adjust a frequency of the ultrasound vibrator and a discharging intensity of the discharge unit.

Mode for the Invention

Hereinafter, the present invention will be described more fully with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to one of ordinary skill in the art. Sizes of components in the drawings may be exaggerated for convenience of explanation. Like reference numerals in the drawings denote like elements. In the description of the present invention, certain detailed explanations of the related art are omitted when it is deemed that they may unnecessarily obscure the essence of the present invention.

Embodiments of a floating type humidifier according to the present invention will be described in detail with reference to accompanying drawings.

Figure 2:
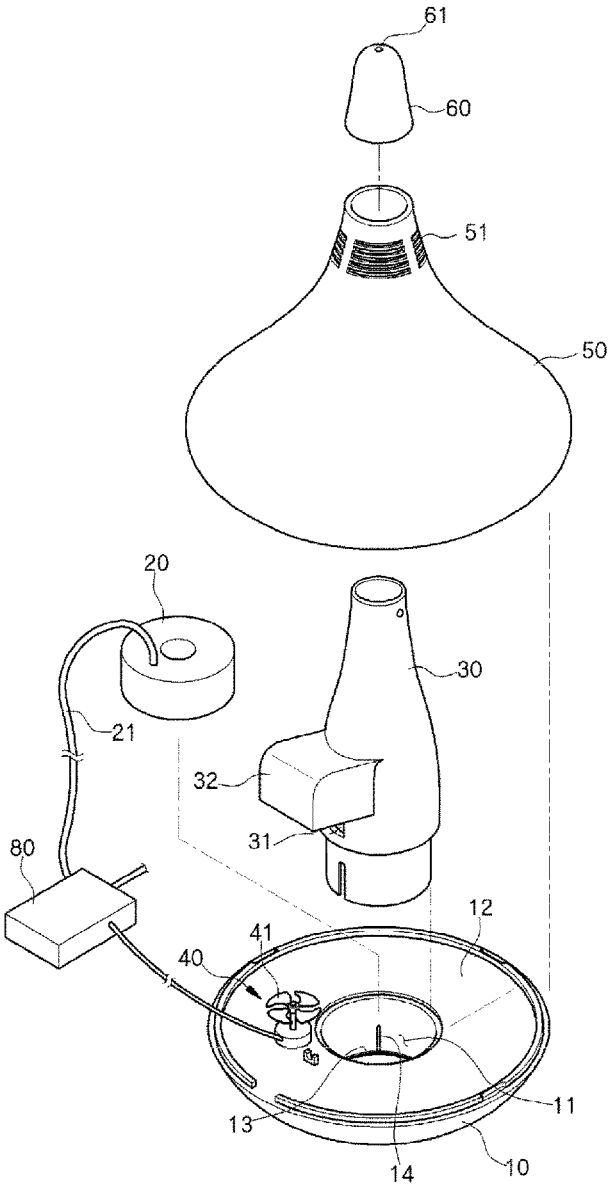
FIG. 2 is an exploded perspective view of the floating type humidifier of FIG. 1.
Figure 3:
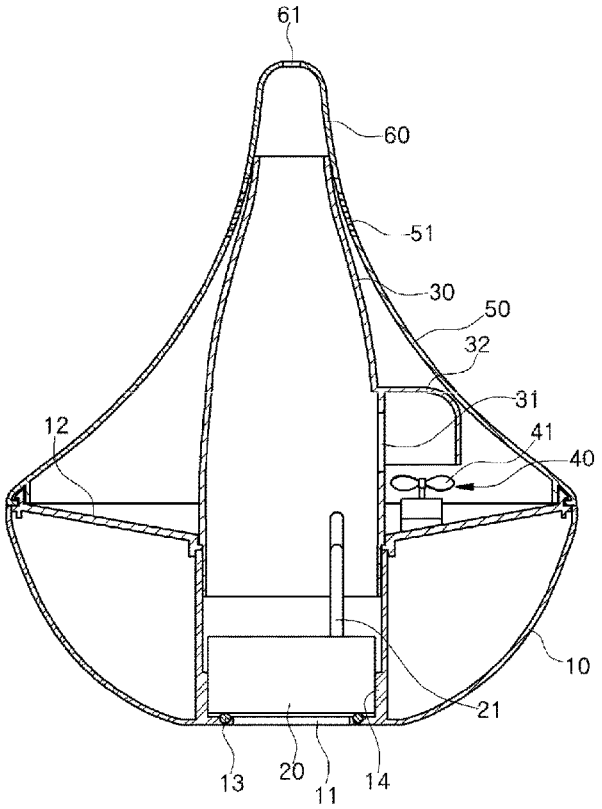
FIG. 3 is a cross-sectional view of the floating type humidifier of FIG. 1.
Figure 4A:
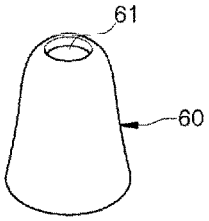
FIGS. 4A through 4C are diagrams showing various modifications of a cap shown in FIG. 1.
Figure 4B:
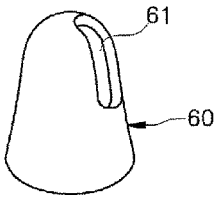
Figure 4C:
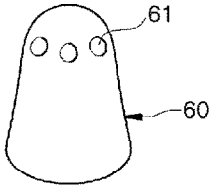
Figure 5:
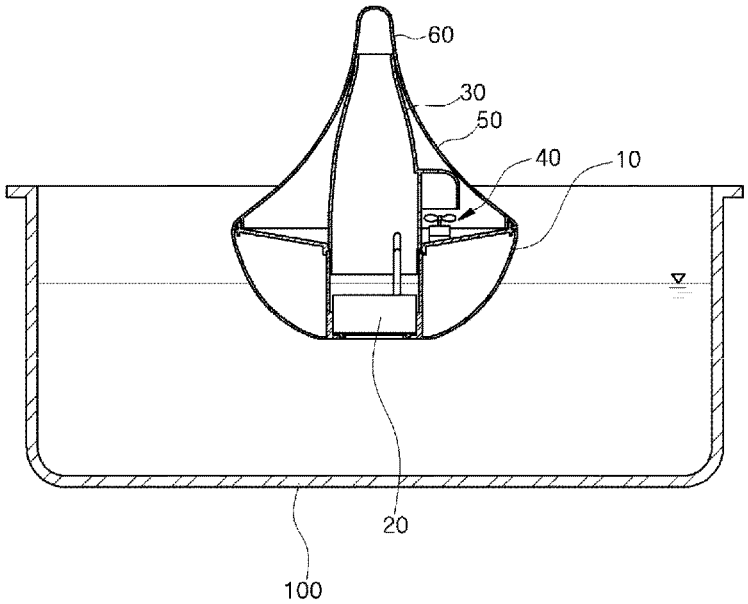
FIG. 5 is a diagram showing a usage status of the present invention.
Figure 6:
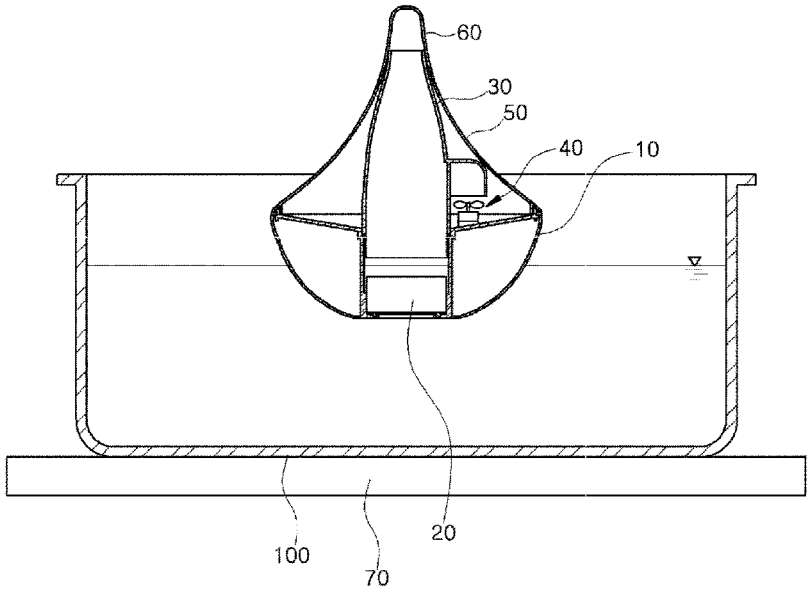
FIG. 6 is a diagram of a floating type humidifier according to another embodiment of the present invention.

FIG. 1 is a perspective view of a floating type humidifier according to an embodiment of the present invention, FIG. 2 is an exploded perspective view of the floating type humidifier of FIG. 1, FIG. 3 is a cross-sectional view of the floating type humidifier of FIG. 1, FIGS. 4A through 4C are diagrams showing various modifications of a cap shown in FIG. 1, FIG. 5 is a diagram showing a usage status of the present invention, and FIG. 6 is a diagram of a floating type humidifier according to another embodiment of the present invention.

Referring to FIGS. 1 through 6, the floating type humidifier according to the present embodiment includes a floating body 10 having a hollow and a water inlet hole 11 at a side thereof through which water is introduced from the outside. In more detail, the floating body 10 is formed like a container and the water inlet hole 11 formed through a center portion of the floating body 10.

Also, a plurality of protrusions contacting an outer surface of an ultrasound vibrator 20 that support the ultrasound vibrator 20 and will be described later to are formed on an inner wall surface of the water inlet hole 11, and a packing 13 is coupled to a lower edge of the water inlet hole 11 to absorb shocks from the ultrasound vibrator 20.

Also, if water particles or vapour generated by an ultrasound vibrator 20 that will be described below may not be discharged to outside the humidifier but formed on a guide 30 and a case 50 that will be described below, an inclined portion 12 is formed on an upper surface of the floating body 10 so that the water particles or vapour may flow along an outer surface of the guide 30 and an inner surface of the case 50 and may be introduced to the water inlet hole 11.

In addition, the inclined portion 12 may allow the water that passed through a coupling portion between the floating body 10 and the case 50 to be introduced into the water inlet hole 11, besides the above described function, that is, the inclined portion 12 may allow the water to flow along the outer surface of the guide 30 and the inner surface of the case 50 to be introduced into the water inlet hole 11.

Therefore, the floating body 10 may be sealed and float on water when the inclined portion 12 is bonded to the upper surface thereof.

Meanwhile, the ultrasound vibrator 20 may be further provided to be inserted in the water inlet hole 11 of the floating body 10 to generate water particles or vapour from the water introduced from a water container 100. The ultrasound vibrator 20 converts the water into water particles of vapour through fast vibrations, and discharges the generated water particles to the outside. The ultrasound vibrator 20 may be used in a generally used ultrasound humidifier, and thus, detailed descriptions thereof are omitted.

The guide 30 formed like a pipe is coupled to an upper end portion of the water inlet hole 11 in the floating body 10. The guide 30 guides water particles or vapour generated by the ultrasound vibrator 20 to the outside and includes a guide hole 31 in a side surface thereof.

In addition, the guide 30 includes a shielding portion 32 having a '?'-shaped cross-section on an upper portion of the guide hole 31 so as to prevent air supplied through a discharge unit 40 from leaking to the outside, and the shielding portion 32 protrudes from the guide 30.

In addition, the discharge unit 40 is coupled to the upper end portion of the water inlet hole 11 so as to guide the water particles or vapour discharged through the guide 30 to the guide hole 31 and to discharge the water particles or vapour to the outside. As shown in the drawings, the discharge unit 40 includes a ventilation fan 41. However, the discharge unit 40 may include an air pump.

In addition, the discharge unit 40 may increase an internal pressure in the guide 30 so as to discharge the water particles and the vapour to the outside.

Therefore, humidification may be sufficiently performed by using the discharge unit 40.

Meanwhile, a control unit 80 for controlling electric power supplied to the ultrasound vibrator 20 and the discharge unit 40 may be included in the ultrasound vibrator 20 and the discharge unit 40. The control unit 80 adjusts a frequency of the ultrasound vibrator 20 or a discharging intensity of the discharge unit 40.

Therefore, the electric power supplied to the ultrasound vibrator 20 may be adjusted via the control unit 80 to adjust a sprayed amount, or the number of rotations of the ventilation fan 41 and an air discharge amount from the air pump may be adjusted via the control unit 80 to adjust the sprayed amount.

In addition, the case 50 is coupled to the upper end portion of the floating body 10 so as to accommodate the guide 30 and includes a plurality of air inlet holes 51 in an outer side portion thereof for passage of external air.

Also, a cap 60 is coupled to an upper end portion of the case 50 and includes an evaporation hole 61 so as to control an evaporation amount and an evaporation direction of the water particles or the vapour discharged through the guide 30. The evaporation hole 61 may be formed in various directions as shown in FIGS. 4A through 4C. The evaporation hole 61 of FIG. 4A is used when a spray amount that is greater than that of the cap 60 shown in FIG. 1 is necessary, the evaporation hole 61 of FIG. 4B is used when the water particles and the vapour is sprayed in one direction only, and a plurality of evaporation holes 61 formed in an outer side surface of the cap 60 in FIG. 4C are used to evaporate the water particles and the vapour in a radial direction.

That is, the sprayed amount may be also adjusted by using the cap 60, in addition to the control of the control unit 80. As described above, if the evaporation hole 61 is large (see FIG. 4A), the water particles or the vapour is sprayed straightforward. However, if the evaporation hole 61 is small (see FIG. 2), the water particles or the vapour is sprayed and spreads on a bottom of a humidified space. The evaporation hole 61 may be one through hole in the drawings. However, two or more evaporation holes 61 may be formed (see FIG. 4C) to obtain an aesthetic effect.

The ultrasound vibrator 20 may have a light emitting diode (LED) on a surface thereof, that is, an upper surface thereof. Therefore, light may be emitted upward from the LED so as to illuminate a ceiling, and thus, the floating type humidifier may have a mood lighting function. In this case, the cap 60 may be formed of a transparent or a semi-transparent material.

Moreover, the case 50 may include an LED on an outer surface thereof so as to illuminate the water particles or the vapour that is discharged through the cap 60 after passing through the guide 30, thereby increasing an asesthetic effect.

In addition, electric power may be supplied to the ultrasound vibrator directly via a power wire 21. However, the ultrasound vibrator 20 may be rechargeable, that is, the ultrasound vibrator 20 may include a rechargeable battery (not shown) so that the ultrasound vibrator 20 may be recharged when it does not operate.

Otherwise, external electric power from the outside of the water container 100 may be directly and wirelessly supplied to the ultrasound vibrator 20, without using the rechargeable battery in the ultrasound vibrator 20.

For example, as shown in FIG. 6, the floating type humidifier may be configured to be recharged wirelessly when performing the humidification function by using a wireless charging pad 70 disposed under a bottom of the water container 100. In more detail, an induced current is generated corresponding to an electromagnetic field provided from the wireless charging pad 70, and the induced current is used to charge a battery (not shown) in the ultrasound vibrator to drive the ultrasound vibrator.

Hereinafter, a usage state of the floating type humidifier having the above structure will be described.

As shown in FIG. 5, when a main body of the humidifier is placed in the water container 100 containing water, the humidifier floats on water due to the floating body 10 having a sealed hollow. Then, when a power source is connected to the humidifier, the ultrasound vibrator 20 starts to operate.

In this case, since the ventilation fan 41 is also driven to generate an air current, the air current blows via the guide hole 31 so that the water particles or the vapour generated by the ultrasound vibrator 20 is discharged to the outside via the upper portion of the guide 30. The sprayed amount may be adjusted by the control unit 80.

As the air is introduced through the air inlet hole 51 formed in the surfaces of the case 50 due to the rotation of the fan 41, the water particles or vapour generated by the ultrasound vibrator 20 may be discharged to the outside due to the introduced air.

The water particles or the vapour may not be discharged to the outside, and may be formed as droplets on the inner surface of the case 50 and the outer surface of the guide 30. In this case, the droplets may flow along the inner surface of the case 50 and the outer surface of the guide 30 to the inclined portion 12, and then, the droplets are drained to the water inlet hole 11 due to the inclination of the inclined portion 12 and introduced into the water container 100.

In addition, according to the floating type humidifier of the embodiment of the present invention, all components thereof may be easily disassembled from or coupled to each other, and thus, slime or moss that may be generated when the humidifier is used for a long time may be easily cleaned by disassembling the humidifier. After cleaning the components, the components may be easily assembled in an opposite manner to the disassembling manner.

While this invention has been particularly shown and described with reference to preferred embodiments thereof, it will be understood by those skilled in the art that various changes in form and details may be made therein without departing from the spirit and scope of the invention as defined by the appended claims. The preferred embodiments should be considered in descriptive sense only and not for purposes of limitation. Therefore, the scope of the invention is defined not by the detailed description of the invention but by the appended claims, and and it is to be appreciated that all changes, equivalents, and substitutes that do not depart from the spirit and technical scope of the present invention are encompassed in the present invention.

LEGEND OF REFERENCE NUMERALS

10: floating body 11: water inlet hole
12: inclined portion 13: packing
14: protrusion 20: ultrasound vibrator
30: guide 31: guide hole
40: discharge unit 41: ventilation fan
50: case 51: air inlet hole

60: cap 61: evaporation hole
70: wireless charging pad 80: control unit
100: water container

The invention claimed is:

1. A floating type humidifier comprising:

a floating body having a hollow and a water inlet hole in a lower portion through which water is introduced from the outside so that the floating body floats in a water container;

an ultrasound vibrator inserted in the water inlet hole of the floating body to change the water introduced from the water container into water particles or vapor;

a guide coupled to an upper end portion of the water inlet hole of the floating body to guide the water particles or the vapor generated by the ultrasound vibrator to the outside, and formed like a pipe having a guide hole in a side surface; and a discharge unit provided on the floating body under the guide hole so as to guide the water particles or the vapor from the guide to the guide hole and to discharge the water particles or the vapor to the outside.

2. The floating type humidifier of claim 1, wherein the floating body further comprises a case coupled to an upper portion of the floating body so as to accommodate the guide and comprising a plurality of air inlet holes in an outer portion for inducing external air.

3. The floating type humidifier of claim 2, wherein the case further comprises a cap coupled to an upper end portion of the case and comprising an evaporation hole for controlling an evaporation amount and an evaporation direction of the water particles or the vapor discharged through the guide.

4. The floating type humidifier of claim 3, wherein one or more evaporation holes are formed in a tip portion or a side surface of the cap.

5. The floating type humidifier of claim 3, wherein the case comprises a light emitting diode (LED) on an outer surface to illuminate the water particles or the vapor evaporated through the guide.

6. The floating type humidifier of claim 1, wherein the discharge unit comprises one of a ventilation fan and an air pump.

7. The floating type humidifier of claim 1, wherein electric power is supplied to the ultrasound vibrator via a power line or a rechargeable battery.

8. The floating type humidifier of claim 1, wherein electric power is wirelessly supplied to the ultrasound vibrator.

9. The floating type humidifier of claim 8, wherein the ultrasound vibrator is driven by electric power supplied wirelessly from a wireless charging pad provided under a bottom of the water container or from outside of the water container.

10. The floating type humidifier of claim 1, wherein the ultrasound vibrator comprises an LED on an upper surface to emit light through an upper portion of the guide.

11. The floating type humidifier of claim 1, wherein the guide further comprises a shielding portion protruding from an upper portion of the guide hole to the outside so as to collect the air supplied through the discharge unit toward the guide hole.

12. The floating type humidifier of claim 1, wherein the floating body further comprises an inclined portion formed on an upper surface of the floating body, so that the water particles or the vapor that is generated by the ultrasound vibrator and is not discharged to the outside but is formed as droplets on the guide and the case flows along an outer surface of the guide and an inner surface of the case toward the water inlet hole, or the water introduced through a coupling portion between the floating body and the case is drained to the water inlet hole.

13. The floating type humidifier of claim 1, wherein the ultrasound vibrator and the discharge unit further comprise a control unit for controlling electric power supplied to the ultrasound vibrator and the discharge unit so as to adjust a frequency of the ultrasound vibrator and a discharging intensity of the discharge unit.

* * * * *